US007523636B2

(12) United States Patent
Bessa Pacheco et al.

(10) Patent No.: US 7,523,636 B2
(45) Date of Patent: Apr. 28, 2009

(54) FRONT CLAMPING SYSTEM WITH MOVABLE INTERMEDIATE BARS FOR CLAMPING ASYMMETRIC BENDING TOOLS WITH A FRONT OR REAR ORIENTATION

(75) Inventors: José António Bessa Pacheco, Geifães (PT); Manuel Cunha Passos Barbosa, Oporto (PT)

(73) Assignee: Dias Ramos-Maquinas-Ferramentas, LDA, Oporto (PT)

( * ) Notice: Subject to any disclaimer, the term of this patent is extended or adjusted under 35 U.S.C. 154(b) by 618 days.

(21) Appl. No.: 10/545,704

(22) PCT Filed: Feb. 9, 2004

(86) PCT No.: PCT/PT2004/000003

§ 371 (c)(1),
(2), (4) Date: Aug. 17, 2005

(87) PCT Pub. No.: WO2004/071688

PCT Pub. Date: Aug. 26, 2004

(65) Prior Publication Data

US 2006/0156788 A1 Jul. 20, 2006

(30) Foreign Application Priority Data

Feb. 20, 2003 (PT) ..... 102913

(51) Int. Cl.
*B21D 5/02* (2006.01)

(52) U.S. Cl. ..... 72/481.2; 72/481.6; 72/482.2

(58) Field of Classification Search ..... 72/479, 72/481.1, 481.2, 481.6, 482.2, 482.6
See application file for complete search history.

(56) References Cited

U.S. PATENT DOCUMENTS

| | | | | |
|---|---|---|---|---|
| 4,534,203 | A * | 8/1985 | Cros | 72/481.7 |
| 6,151,951 | A * | 11/2000 | Kawano | 72/481.2 |
| 6,557,390 | B2 * | 5/2003 | Runk et al. | 72/482.1 |
| 6,644,090 | B2 * | 11/2003 | Gasparini | 72/482.2 |
| 7,069,766 | B2 * | 7/2006 | Hayashi et al. | 72/481.3 |

FOREIGN PATENT DOCUMENTS

| | | | |
|---|---|---|---|
| EP | 0 630 699 | A1 | 12/1994 |
| JP | 62-212019 | A | 9/1987 |

* cited by examiner

*Primary Examiner*—David B Jones
(74) *Attorney, Agent, or Firm*—Birch, Stewart, Kolasch & Birch LLP

(57) ABSTRACT

A system for quickly clamping asymmetric bending tools with either a rear or front orientation using front side and rear side clamping bars on opposite sides of a support body. The clamping system includes front and rear side intermediate bars that are unbalanced as to a clamping screw that passes there so as to hang down adjacent to opposed front and rear sides of the support body. Thus, the intermediate bars on the front side of the support body or the intermediate bars on the rear side of the support body can be independently engaged and swung up by a tool surface on that same side of the support body when the tool is inserted into the clamping system on that same side. The unbalanced intermediate bars that are not engaged by an inserted support surface of the tool remain in the unbalanced state on the opposite side.

5 Claims, 1 Drawing Sheet

FRONT CLAMPING SYSTEM WITH MOVABLE INTERMEDIATE BARS FOR CLAMPING ASYMMETRIC BENDING TOOLS WITH A FRONT OR REAR ORIENTATION

BACKGROUND OF THE INVENTION

The present innovations refers to a quick front clamping system for bending tools normally mounted in machines that can be, among others, press brakes and folders. These tools are asymmetric and can be mounted to either to face the front side of the clamping system or to face the rear side of the clamping system.

In these machines the operator is normally positioned at the front. Whenever the tools are changed, the fixing of their position has to be done from the front for safety reasons. These tools should be mounted turned to the front or to the back due to job suitability.

BRIEF SUMMARY OF THE INVENTION

It is an object of the present invention to provide clamping of the above noted tools in a quick and safe manner.

Accordingly, a clamping system that clamps an asymmetric bending tool with a clamping portion is provided. The clamping system has a front side and a rear side and comprises;

a front side clamping bar and a rear side clamping bar;

at least one damping element extending from the front side clamping bar to the rear side clamping bar;

at least one intermediate front side bar positioned between the front side clamping bar and a first portion of a support body facing the front side of the clamping system; and at least one intermediate rear side bar positioned between the rear side clamping bar and a second portion of the support body facing the rear side of the clamping system, wherein the at least one intermediate front side bar and the at least one intermediate rear side bar are mounted so that each will hang downwardly adjacent to a corresponding one of the first portion and second portion of the support body, wherein the at least one intermediate front side bar is swung upwardly by engaging a support surface of a tool portion when its clamping portion is inserted into the clamping system to orient the asymmetric bending tool to the rear side of the clamping system, and wherein the at least one intermediate rear side bar is swung upwardly by engaging the support surface of the tool portion when its clamping portion is inserted into the clamping system to orient the asymmetric bending tool to the front side of the clamping system.

DETAILED DESCRIPTION OF THE INVENTION

Figure 1:
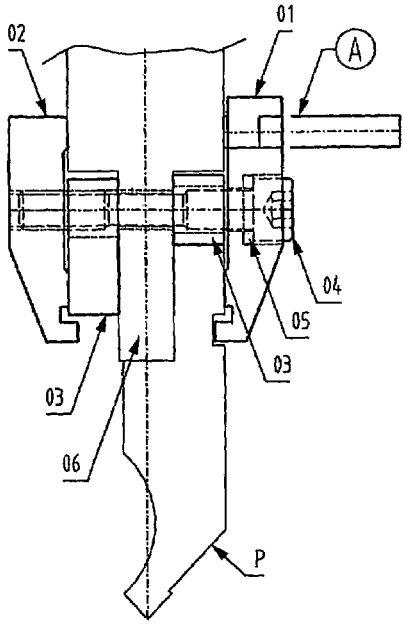
FIG. 1 shows a side view of The clamping system including a lever and with the tooling element clamped to face a rear clamping bar.

To ensure this reversible asymmetric tool orientation by front clamping in a quick and safe way, the clamping system of this invention (FIG. 1) is provided with two clamping bars, one at the front (01) and one at the rear (02). These two clamping bars are connected together by at least one screw (04) that goes through the tool support body, connected to one of the machine parts and normally called beam (on the press brakes) or beam and holddown (on the folders).

There are some intermediate bars (03) placed between the clamping bars (01) and (02) and the support body (06) to mount the tools. Each pair of intermediate bar is supported in an unbalanced way in relation to the screw (4) that passes through these intermediate bars (03) as clearly shown relative to the rear (left most) intermediate bar (03) in FIGS. 1 and 3 and the front (right most) intermediate bar (03) in FIGS. 2 and 4.

Figure 2:
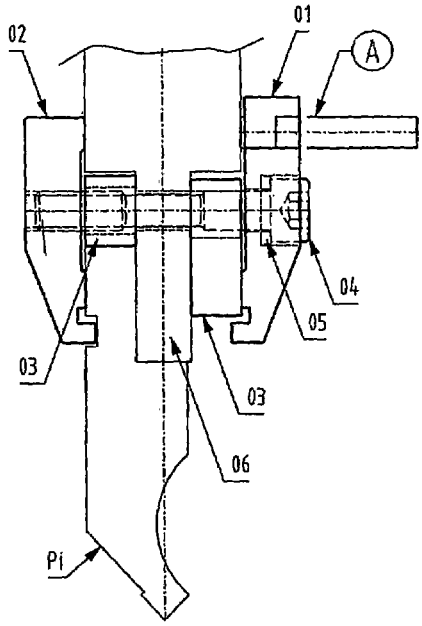
FIG. 2 shows a side view of the clamping system including a lever and with the tooling element clamped to face a front clamping bar.
Figure 3:
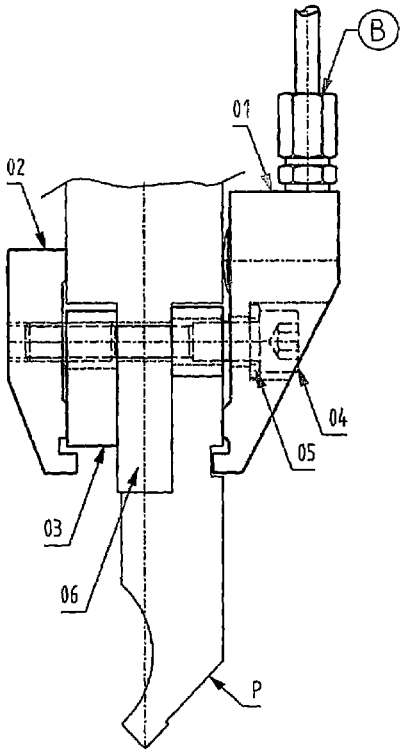
FIG. 3 shows a side view of the clamping system including an electric, pneumatic or hydraulic clamping system with the tooling element clamped to face a rear clamping bar.
Figure 4:
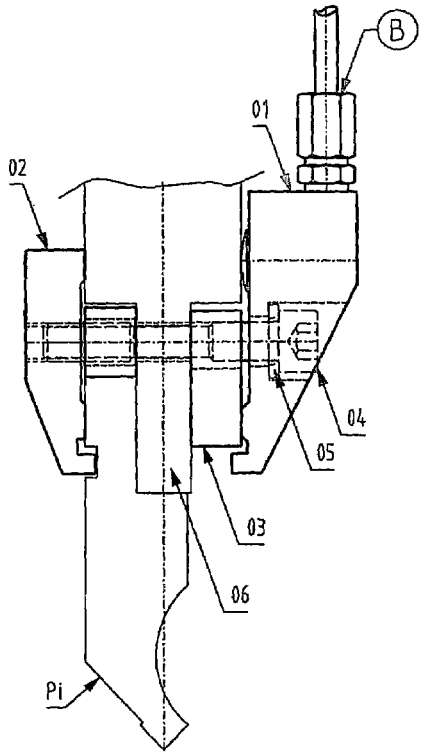
FIG. 4 shows a side view of the clamping system including an electric, pneumatic or hydraulic clamping system with the tooling element damned to face a front clamping bar.

When there is no tool being clamped, the heaviest part of the unbalanced intermediate bars (03) extending from where the screw (04) passes there through falls into the hanging position as shown by the rear (left most) intermediate bars (03) FIGS. 1 and 3 and the front (right most) intermediate bars (03) of FIGS. 2 and 4. Thus, when the tool is inserted into either one of the sides of the clamping system, the intermediate bars (03) located on that side where the tool is inserted will turn, i.e., swing-up into the space that goes from the top of the tool(P or Pi) tang portion to the support body (06). Note the showing of the turned intermediate bars (03) as the front (right most) side intermediate bars (03) in FIGS. 1 and 3 and as the back (left most) side intermediate bars (03) in FIGS. 2 and 4 that show the end surface of the intermediate bars (03) that are exposed by this swinging-up thereof.

Accordingly, independently of whether the tool is mounted with a backward orientation (P) or a frontward orientation (Pi), its clamping can always be done from the front of the machine by means of the clamping bar (01) by acting over A or B once the intermediate bars (03) that fill in the space between the clamping bars (01) or (02) and the support body (06) when there is no tool (P or Pi) support portion on that side of the support body.

This clamping system can be used with quick clamping bar systems using a lever ("A" in FIGS. 1 and 2) or by using an electric, pneumatic or hydraulic adjunct (as shown by FIGS. 3 and 4).

The invention claimed is:

1. A clamping system that clamps an asymmetric bending tool with a clamping portion, the clamping system having a front side and a rear side and comprising;

a front side clamping bar and a rear side clamping bar;

at least one clamping element extending from the front side clamping bar to the rear side clamping bar;

at least one intermediate front side bar positioned between the front side clamping bar and a first portion of a support body facing the front side of the clamping system; and at least one intermediate rear side bar positioned between the rear side clamping bar and a second portion of the support body facing the rear side of the clamping system, wherein the at least one intermediate front side bar and the at least one intermediate rear side bar are mounted so that each wilt hang downwardly adjacent to a corresponding one of the first portion and the second portion of the support body, wherein the at least one intermediate front side bar is swung upwardly by engaging a support surface of a tool portion when its clamping portion is inserted into the clamping system to orient the bending tool to the rear side of the clamping system, and wherein the at least one intermediate rear side bar is swung upwardly by engaging the support surface of the tool portion when its clamping portion is inserted into the clamping system to orient the asymmetric bending tool to the front side of the clamping system.

2. The quick front clamping system according to claim 1, wherein the at least one intermediate rear side bar remains oriented downward to extend adjacent to the second portion of the support body when the asymmetric tool is clamped to orient the asymmetric bending tool to the rear side of the clamping system with the at least one intermediate front side bar having been swung upwardly.

3. The quick front clamping system according to claim 1, wherein the at least one intermediate front side bar remains oriented downward to extend adjacent to the first portion of the support body when the asymmetric tool is clamped to orient the asymmetric bending tool to the front side of the clamping system with the at least one intermediate rear side bar having been swung upwardly.

4. The quick front damping system according to claim 1, wherein the clamping element includes a screw.

5. The quick front clamping system according to claim 4, wherein clamping is accomplished in association with a mechanical, a pneumatic, electrical or hydraulic system.

* * * * *